US005415708A

United States Patent [19]

Young et al.

[11] Patent Number: 5,415,708

[45] Date of Patent: May 16, 1995

[54] ALUMINUM BASE ALLOY AND METHOD FOR PREPARING SAME

[75] Inventors: David K. Young, Henderson, Ky.; William C. Setzer; Francis P. Koch, both of Evansville, Ind.; Robert A. Rapp, Columbus, Ohio; Michael J. Pryor, Woodbridge, Conn.; Noel Jarrett, New Kensington, Pa.

[73] Assignee: KBAlloys, Inc., Robards, Ky.

[21] Appl. No.: 71,187

[22] Filed: Jun. 2, 1993

[51] Int. Cl.[6] ..... C22C 1/02

[52] U.S. Cl. ..... 148/437; 420/552

[58] Field of Search ..... 420/552, 535, 543, 551, 420/590; 148/437, 438, 439, 440; C22C 1/03

[56] References Cited

U.S. PATENT DOCUMENTS

| | | | |
|---|---|---|---|
| 2,578,098 | 12/1951 | Southard | 420/552 |
| 3,464,816 | 9/1969 | Biddulph | 420/552 |
| 3,785,807 | 1/1974 | Backerud | 420/552 |
| 3,961,995 | 6/1976 | Alliot et al. | 420/552 |
| 4,298,408 | 11/1981 | Langdon et al. | 148/437 |
| 5,057,150 | 10/1991 | Reeve et al. | 420/552 |
| 5,100,618 | 3/1992 | Dewing et al. | 420/528 |

FOREIGN PATENT DOCUMENTS 54-114411 9/1979 Japan .

*Primary Examiner*—Scott Kastler
*Assistant Examiner*—Sean Vincent
*Attorney, Agent, or Firm*—Bachman & LaPointe

[57] ABSTRACT

Aluminum base alloy consisting essentially of from 0.1 to 3.0% boron, from 1 to 10% titanium and the balance essentially aluminum wherein the aluminum matrix contains $TiB_2$ particles dispersed throughout said matrix having an average particle size of less than 1 micron, and wherein the matrix contains clusters of said $TiB_2$ particles greater than 10 microns in size with an average of less than 4 of said clusters per 2 $cm^2$. The alloy is prepared by adding a boron containing material selected from the group consisting of borax, boron oxide, boric acid and mixtures thereof, and $K_2TiF_6$ to a bath of molten aluminum and stirring the molten mixture.

8 Claims, No Drawings

ALUMINUM BASE ALLOY AND METHOD FOR PREPARING SAME

BACKGROUND OF THE INVENTION

The aluminum-titanium-boron ternary system is commonly used as grain refiners in aluminum melts in order to obtain a small, equiaxed grain size during solidification. This is important in order to increase the resistance to ingot cracking and in order to improve the mechanical properties and the surface quality of the aluminum alloys produced.

It is desirable, therefore, to produce such aluminum-titanium-boron alloys efficiently and with a minimum cost.

In addition, preparation of such alloys results in the formation of titanium diboride particles and clusters of said particles which are insoluble in the aluminum matrix. Although titanium diboride particles are desirable, it is desirable to minimize growth of the titanium diboride particles and clusters since they reduce the effectiveness of the alloy. Still further, preparation of such alloys results in the formation of $TiAl_3$ particles and large titanium aluminide particles may cause processing problems.

In addition, currently $KBF_4$ is commonly used as a commercial source of boron in obtaining these alloys; however, this material has a high cost which adds greatly to the raw material costs in producing these alloys.

U.S. Pat. No. 3,961,995 describes a process for producing certain aluminum-titanium-boron alloys including the formation of titanium diboride by reacting liquid aluminum with titanium oxide and boron oxide in solution in molten cryolite and quenching the alloy rapidly to cool and solubilize the reaction product. However, this reference is limited to boron contents of 0.2 to 0.8% and requires high operating temperatures generally in excess of 1000° C.

Accordingly, it is a principal object of the present invention to provide an improved process for forming an aluminum base alloy containing titanium and boron.

It is a further object of the present invention to provide a process as aforesaid which is convenient and expeditious to perform and which is economical in commercial practice.

It is a still further object of the present invention to provide an improved aluminum-titanium-boron alloy.

Further objects and advantages of the present invention will appear hereinbelow.

SUMMARY OF THE INVENTION

In accordance with the present invention, the foregoing objects and advantages are readily obtained.

The method of the present invention forms an aluminum base alloy containing titanium and boron, including the steps of: providing a bath of molten aluminum; adding to the melt a boron containing material selected from the group consisting of borax, boron oxide, boric acid and mixtures thereof, and $K_2TiF_6$ and stirring the molten bath to intimately admix the boron containing material, the $K_2TiF_6$ and the molten aluminum and to form an aluminum base alloy containing titanium and boron. The boron containing material should desirably be mixed with or added to the melt before the $K_2TiF_6$. The preferred boron containing material is calcined borax and it is preferred to use a ratio of at least 5 parts titanium to 1 part boron. In one preferred practice, an inert salt cover is provided over the bath of molten aluminum (preferably at least in part consisting of potassium-aluminum-fluoride), the mixture of boron containing material and $K_2TiF_6$ (potassium salt) are added to the molten aluminum to form a molten mixture and the molten mixture stirred for at least 10 minutes.

The resultant aluminum-titanium-boron alloy is characterized by improved properties and consists essentially of boron from 0.1 to 3.0%, preferably from 0.1 to 1.0%, titanium from 1 to 10%, preferably, from 2 to 5% and the balance essentially aluminum. The alloy produces an average grain size of below 300 microns when added to aluminum and preferably below 250 microns. All percentages herein are percentages by weight.

In addition, the aluminum-titanium-boron alloy contains $TiB_2$ particles dispersed throughout said matrix having an average particle size of less than 1 micron. Still further, the matrix contains fewer of the undesirable clusters of said $TiB_2$ particles, with said clusters being defined as greater than 10 microns in size and with said matrix containing an average of less than 4 of said clusters per 2 $cm^2$, preferably less than 3 of said clusters per 2 $cm^2$. The aluminum-titanium-boron alloy contains $TiAl_3$ particles having a desirably small particle size with the average titanium aluminide diameter being less than 25 microns and preferably less than 20 microns.

The foregoing results in a convenient and expeditious manner of forming said alloy and results in an improved alloy system.

Further features of the present invention will appear hereinbelow.

DETAILED DESCRIPTION

In accordance with the present invention, aluminum alloys are formed containing titanium and boron. The alloys prepared include from 0.1 to 3.0% boron, preferably from 0.1 to 1.0%, and from 1 to 10% titanium, preferably from 2 to 5%, with the balance essentially aluminum. Naturally, other alloying additions may readily be utilized in accordance with the present invention and conventional impurities are contemplated.

The process of the present invention adds the boron and titanium containing materials to a bath of molten aluminum, maintained at a temperature in excess of 1220° F.

The present invention adds a boron containing material selected from the group consisting of borax, boron oxide and boric acid and mixtures thereof plus $K_2TiF_6$. It is preferred to employ borax, $Na_2B_4O_7$, with calcined materials being preferred, and one generally employs calcined borax. It is also preferred to premix the boron and titanium containing materials and it is also preferred to use a ratio of at least 5 parts titanium to 1 part boron provided by the borax. Smaller ratios than 5 to 1 may be employed, if desired; however, at smaller ratios aluminum oxide, which is a by product of the reaction, increases the viscosity of the spent salt which forms over the molten aluminum making it difficult to separate the salt and aluminum. When the salt is viscous, titanium and boron recoveries are also lower.

The reaction of calcined borax with the aluminum produces aluminum oxide. Using the ratio of at least 5 parts titanium to 1 part boron, the concentration of oxide present in the spent salt is around 18%, the apparent maximum in solution, while keeping the spent salt relatively fluid at the standard operating temperature.

The reason for the high ratio is so that the spent salt remains fluid and can be readily separated from the aluminum. If the spent salt is too viscous, it will be partially entrained in the product which is undesirable. If the ratio is low, a preferred practice would be to use an inert salt cover. The lowest titanium to boron ratio contemplated would be 2.2:1. In this case, the oxide concentration is 32% in the spent salt. Therefore, an inert salt should be added such that the oxide concentration is no more than 18% in the spent salt.

A portion of the boron may be provided by $KBF_4$, preferably as a separate addition, especially for low titanium content alloys.

An inert salt cover may be used over the molten aluminum and can act as an oxide absorber. This facilitates the use of a lower titanium-boron ratio. Experimentation has shown that an inert salt cover will not affect the recoveries of the boron or titanium. Fluoride salts are preferred for the inert salt cover, and one can combine fluorides and chlorides. Potassium-aluminum-fluoride or potassium cryolite is a preferred material for the salt cover. Lower melting point salts are preferred for the salt cover with the melting point naturally being in excess of the 1220° F. melting point of the aluminum bath, and it is preferred to employ inert salts with melting points below about 1850° F. It is preferred to employ a sufficient amount of salt cover to absorb the aluminum oxide which is a product of the reaction, and generally an inert salt cover of at least 6 inches is employed in order to prevent additional aluminum oxidation due to aluminum exposure while stirring vigorously.

The molten bath contains a fairly large volume fraction of spent salt during the process, which is actually reduced in terms of total volume using the process of the present invention. Moreover, the throughput is improved in the process of the present invention and thus is an advantage of the present invention. For example, borax contains 21.5% boron and $KBF_4$ contains 8.6% boron, which means that a larger volume of $KBF_4$ is added when using this material.

As indicated hereinabove, it is preferred to form a mixture of the boron containing material and the $K_2TiF_6$ and add the mixture to the molten bath. If the boron containing material is added last, the recovery is low. If the boron containing material is added first, there is a possibility that there will be incomplete mixing and consequently recoveries can be affected. The method of addition is not particularly critical, although it is desirable that one intimately admix the boron containing material, the titanium containing material and the molten aluminum. Thus, the reaction mixture should be thoroughly stirred.

The reaction time is not especially critical. If one employs a mixture of the boron and titanium containing materials, an instantaneous reaction occurs. If a mixture of the boron and titanium containing materials is not employed, a higher reaction temperature should be employed, as for example, between 1600° and 1800° F. The reaction is exothermic so that the temperature will rise during the reaction. The temperature will tend to rise fairly rapidly with a blend of boron and titanium containing materials and fairly slowly if the components are added individually. Reaction times of at least 10 minutes are preferred and preferably less than 2 hours. The reaction is complete when the temperature tends to level off. More rapid reaction times occur using the premixed boron and titanium containing materials than without.

As indicated hereinabove, it is not essential to utilize a salt cover in the process of the present invention. Salt forms during the reaction and forms a salt cover in situ. Therefore, using the aforesaid 5 to 1 ratio, the formation of the salt cover will be sufficient to effectively operate the process of the present invention. Below the 5 to 1 ratio, it is preferred to utilize the inert salt cover.

After the reaction is complete, including intimate admixture of the components, the salt is decanted off.

Grain refiner master aluminum alloys currently produced often contain amounts of titanium and boron and therefore these alloys are important. Conventionally, $KBF_4$ is employed as the commercial source of boron, and sources of titanium include titanium sponge, titanium turnings and $K_2TiF_6$. It is a disadvantage of $KBF_4$ that it has a high cost. Moreover, hard $TiB_2$ particles form in the aluminum matrix. It is desirable to obtain a small particle size for the $TiB_2$ particles. Further, these particles, which include $TiB_2$ complexes, tend to cluster together in the aluminum matrix with clusters over 10 microns in size. The $TiB_2$ and the clusters of $TiB_2$ may cause defects in use, especially in rolling or in the formation of thin gauge products. It is desirable, therefore, to obtain a small particle size for the $TiB_2$ particles and a small number of clusters of same so that when the grain refiner alloy is added to promote grain refining, a smaller number of these particles are present in the final grain refined product.

Furthermore, it is desirable that the aluminum grain refiner alloy be effective to produce a relatively small average grain size in the grain refined product so that a smaller proportion is required to be added.

In accordance with the present invention,the aluminum matrix of the grain refined product has an average grain size below 300 microns and preferably below 250 microns at an addition level of 0.01% titanium when using a 5% Ti/1% B alloy.

In accordance with the present invention, the matrix contains $TiB_2$ particles, including complexes thereof, dispersed throughout the matrix which have an average particle size of less than 1 micron, with many particles approaching 0.1 micron in size. This is a significant advantage in view of the small particle size.

Moreover, the material of the present invention forms fewer clusters of said $TiB_2$ particles. The matrix of the present invention contains clusters of the TiB2 particles, with the clusters being greater than 10 microns in size, and with the matrix containing an average of less than 4 said clusters per 2 $cm^2$, and preferably less than 3 of said clusters per 2 $cm^2$. This represents a significant advantage in view of the small number of $TiB_2$ clusters formed. Conventional materials have substantially greater numbers of these.

The aluminum-titanium-boron alloy of the present invention contains $TiAl_3$ particles having a desirably small particle size. In accordance with the present invention, the average titanium aluminide diameter is less than 25 microns and preferably less than 20 microns. This represents a considerable advantage and indicates that the titanium alumindes in accordance with the present invention are desirably much smaller and therefore more numerous for a given titanium concentration.

The present invention will be more readily understandable from a consideration of the following illustrative examples.

EXAMPLE I

An aluminum melt was formed at a temperature of 1300° F. and using approximately 2000 pounds of aluminum. A blend of $K_2TiF_6$ and borax was prepared using 30 pounds of borax and 300 pounds of $K_2TiF_6$ powder. No salt cover was employed and the blend was added to the melt while stirring. A salt layer formed over the melt during the reaction and the temperature was monitored. The temperature of the melt rose rapidly to about 1500° F. in about 10 minutes, whereupon the temperature levelled off and the reaction was complete. After the reaction was complete a second flux was added containing about 253 pounds of $K_2TiF_6$ and 180 pounds of $KBF_4$. The salt was then decanted. The resulting alloy contained about 5% titanium and 1% boron. The results were evaluated using an average of 10 heats. Titanium and boron recoveries were virtually 100%. The average grain size of a grain refined product at an addition level of 0.01% Ti was less than 250 microns. The average $TiB_2$ particle size in the Al—Ti—B alloy prepared was less than 1 micron. The average number of clusters of $TiB_2$ greater than 10 microns in size per 2 $cm^2$ was about 2.5 in the alloy produced.

EXAMPLE II

The following example essentially repeated the procedure of Example I utilizing $KBF_4$ instead of the borax. The amounts employed were calculated to give a final alloy containing 5% titanium and 1% boron. The mixture was added to the melt while continuously stirring whereupon the temperature rose to 1600° to 1650° F. in from about 30 minutes to 1 hour, and levelled off indicating that the reaction was complete. The results were evaluated based on an average of 10 heats.

The average titanium and boron recoveries were less than in Example I. The average grain size of a grain refined product at an addition level of 0.01% Ti was about 350 microns. The particle size of the $TiB_2$ averaged about 2 microns in the Al—Ti—B alloy produced. Substantially more clusters of $TiB_2$ particles greater than 10 microns in size were found per 2 $cm^2$ with an average of 5.3 of said clusters being found per 2 $cm^2$ sample in the alloy produced.

EXAMPLE III

The following example essentially repeated the procedure of Example I blending 100 pounds of borax with 536 pounds of $K_2TiF_6$. This blend was added to molten aluminum such that the final concentration was 5% Ti and 1% B. A sample of the resultant alloy was examined and it was found that there were three small $TiB_2$ clusters greater than 10 microns in size in a 2 $cm^2$ area. Also, the average $TiAl_3$ diameter was less than 20 microns based on image analysis. High titanium and boron recoveries were obtained. The temperature rise due to the exothermic reaction was about 260° F.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method for forming an aluminum base alloy containing titanium and boron, consisting essentially of:
   providing a bath of molten aluminum;
   adding to the melt (1) a boron containing material wherein said boron containing material consists essentially of borax, and (2) a titanium containing material consisting essentially of $K_2TiF_6$, wherein the boron containing material and the titanium containing material are premixed, followed by adding the mixture to the molten bath and stirring the molten bath to intimately admix the boron containing material, the titanium containing material and the molten aluminum to form an elevated temperature reaction;
   to form an aluminum alloy containing from 1 to 10% titanium and from 0.1 to 3.0% boron, and the balance essentially aluminum, wherein the resultant alloy contains $TiAl_3$ particles having a diameter of less than 25 microns and $TiB_2$ particles dispersed throughout having an average particle size of less than 1 micron;
   including the step of providing an inert salt cover over the bath of molten aluminum, wherein the inert salt cover is at least in part a fluoride salt; and
   wherein the reaction temperature rises and the reaction is complete when the reaction temperature levels off.

2. A method according to claim 1 wherein the titanium to boron ratio by weight in the titanium containing material and boron containing material is at least 2.2:1.

3. A method according to claim 1 wherein borax and $K_2TiF_6$ are mixed together at a ratio by weight of at least 5 parts titanium to 1 part boron, followed by adding the mixture to the molten aluminum.

4. A method according to claim 1 wherein the inert salt cover has a depth of at least 6 inches.

5. A method according to claim 1 wherein a mixture of the boron containing material and the $K_2TiF_6$ are added to the molten aluminum to form a molten mixture and the molten mixture stirred for at least 10 minutes.

6. A method according to claim 1 wherein a fluid spent salt cover forms over the reaction mixture, and including the step of separating the spent salt from the reaction mixture.

7. A method according to claim 1 wherein the resultant alloy contains clusters of said $TiB_2$ particles, with said clusters being defined as greater than 10 microns in size and containing an average of less than 4 of said clusters per 2 $cm^2$.

8. A method according to claim 1 wherein the resultant aluminum alloy is a grain refiner master alloy.

* * * * *